US009174100B2

(12) United States Patent
Takechi

(10) Patent No.: US 9,174,100 B2
(45) Date of Patent: Nov. 3, 2015

(54) HOLLOW GOLF CLUB HEAD AND METHOD OF MANUFACTURING THE SAME

(71) Applicant: BRIDGESTONE SPORTS CO., LTD., Minato-ku, Tokyo (JP)

(72) Inventor: Takaharu Takechi, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 246 days.

(21) Appl. No.: 13/871,621

(22) Filed: Apr. 26, 2013

(65) Prior Publication Data

US 2013/0344987 A1 Dec. 26, 2013

(30) Foreign Application Priority Data

Jun. 22, 2012 (JP) ..... 2012-141166
Jun. 22, 2012 (JP) ..... 2012-141167

(51) Int. Cl.
*A63B 53/04* (2015.01)
*A63B 49/06* (2006.01)

(52) U.S. Cl.
CPC ..... *A63B 53/0466* (2013.01); *A63B 49/06* (2013.01); *A63B 2053/045* (2013.01); *A63B 2053/0433* (2013.01); *A63B 2053/0437* (2013.01); *A63B 2209/00* (2013.01); *Y10T 29/49986* (2015.01); *Y10T 29/49996* (2015.01)

(58) Field of Classification Search
CPC ..... A63B 5/0466; A63B 49/06; A63B 2053/045; A63B 2053/0437; A63B 2209/00; A63B 2053/0433; A63B 53/0466; Y10T 29/49996; Y10T 29/49986
USPC ..... 473/324–350, 287–292
See application file for complete search history.

(56) References Cited

U.S. PATENT DOCUMENTS

| | | | | |
|---|---|---|---|---|
| 4,139,196 | A * | 2/1979 | Riley | 473/242 |
| 4,214,754 | A * | 7/1980 | Zebelean | 473/346 |
| 5,921,872 | A * | 7/1999 | Kobayashi | 473/345 |
| 6,381,828 | B1 | 5/2002 | Boyce et al. | |
| 6,604,568 | B2 | 8/2003 | Bliss et al. | |
| 6,623,376 | B2 | 9/2003 | Poynor | |
| 6,645,087 | B2 * | 11/2003 | Yabu | 473/342 |
| 7,108,614 | B2 * | 9/2006 | Lo | 473/345 |
| 7,134,972 | B2 * | 11/2006 | Hsu et al. | 473/348 |
| 7,250,007 | B2 * | 7/2007 | Lu | 473/329 |
| 7,377,861 | B2 * | 5/2008 | Tateno et al. | 473/345 |
| 7,431,668 | B2 * | 10/2008 | Tateno et al. | 473/346 |
| 7,435,191 | B2 * | 10/2008 | Tateno et al. | 473/346 |

(Continued)

FOREIGN PATENT DOCUMENTS

| | | | |
|---|---|---|---|
| JP | 3056395 | B2 | 6/2000 |
| JP | 2001-346920 | A | 12/2001 |

(Continued)

*Primary Examiner* — Sebastiano Passaniti
(74) *Attorney, Agent, or Firm* — Sughrue Mion, PLLC

(57) ABSTRACT

This invention provides a hollow golf club head including a metal plate portion provided with thin and thick portions. A medium thick portion having an intermediate thickness between the thicknesses of the thin and thick portions is formed at the boundary portion between the thin and thick portions. The thin and medium thick portions are formed by the steps of pressing the metal plate portion to form a recess in one surface of the metal plate portion and a projection on its other surface, performing chemical milling of the recess and a portion surrounding it, and removing the projection by grinding.

4 Claims, 3 Drawing Sheets

(56) References Cited

U.S. PATENT DOCUMENTS

| | | | | |
|---|---|---|---|---|
| 7,455,597 | B2 * | 11/2008 | Matsunaga | 473/329 |
| 7,575,525 | B2 | 8/2009 | Matsunaga et al. | |
| 7,785,213 | B2 | 8/2010 | Matsunaga et al. | |
| 7,819,758 | B2 | 10/2010 | Matsunaga et al. | |
| 7,846,039 | B2 | 12/2010 | Gilbert et al. | |
| 7,942,759 | B2 | 5/2011 | Matsunaga et al. | |
| 8,133,135 | B2 | 3/2012 | Stites et al. | |
| 8,172,697 | B2 * | 5/2012 | Cackett et al. | 473/329 |
| 8,216,089 | B2 | 7/2012 | Matsunaga et al. | |
| 8,221,260 | B2 * | 7/2012 | Stites et al. | 473/324 |
| 8,308,582 | B2 * | 11/2012 | Tanimoto | 473/335 |
| 8,540,590 | B2 * | 9/2013 | Tsukada et al. | 473/345 |
| 8,771,095 | B2 * | 7/2014 | Beach et al. | 473/226 |
| 8,790,196 | B2 * | 7/2014 | Solheim et al. | 473/344 |
| 2005/0034834 | A1 * | 2/2005 | Huang | 164/45 |
| 2013/0310192 | A1 * | 11/2013 | Wahl et al. | 473/331 |
| 2014/0155193 | A1 * | 6/2014 | Takechi | 473/345 |
| 2015/0045147 | A1 * | 2/2015 | Abe | 473/345 |

FOREIGN PATENT DOCUMENTS

| | | | |
|---|---|---|---|
| JP | 2003-10366 | A | 1/2003 |
| JP | 4021727 | B2 | 12/2007 |
| JP | 2008-119445 | A | 5/2008 |
| JP | 2008-154624 | A | 7/2008 |
| JP | 4545178 | B2 | 9/2008 |
| JP | 2009-153802 | A | 7/2009 |
| JP | 2010-530783 | A | 9/2010 |
| JP | 5102084 | B2 | 12/2012 |
| JP | 5135783 | B2 | 2/2013 |
| WO | 2008/157691 | A2 | 12/2008 |

* cited by examiner

HOLLOW GOLF CLUB HEAD AND METHOD OF MANUFACTURING THE SAME

BACKGROUND OF THE INVENTION

1. Field of the Invention

The present invention relates to a hollow golf club head.

2. Description of the Related Art

As wood golf club heads such as driver and fairway wood golf club heads, hollow metallic golf club heads are well known. In general, a hollow wood golf club head has a face portion for hitting a golf ball, a crown portion which forms the upper surface portion of the golf club head, a sole portion which forms the bottom surface portion of the golf club head, a side portion which forms the toe-, back-, and heel-side side surface portions of the golf club head, and a hosel portion. A shaft is inserted into the hosel portion, and fixed by, for example, an adhesive.

Although an aluminum alloy, stainless steel, or a titanium alloy is often used as a material which constitutes the hollow golf club head, titanium alloy in particular is extensively used these days.

Japanese Patent Laid-Open No. 2009-153802 describes a golf club head having a thin portion at the central portion of the crown portion, and a thick portion surrounding it. The thin portion is formed by casting and chemical milling. In this golf club head, portions other than the face portion are integrally molded by casting, and a bulged portion is formed in the crown portion to bulge outwards. After casting, the protrusion of the bulged portion is removed by chemical milling to form a thin portion.

In Japanese Patent Laid-Open No. 2009-153802 mentioned above, only thin and thick portions are formed in the crown portion. With such a structure, a step between the thin and thick portions is large, so stress is likely to concentrate at the boundary portion between the thin and thick portions upon striking a golf ball.

To solve this problem, a medium thick portion can be formed between the thin and thick portions, and a cavity-shaped mold for casting, which has a step portion for forming the medium thick portion, is used in this case. It is thus necessary to use a mold with another shape every time the width and thickness of the medium thick portion are changed, thus increasing the cost of the molds.

As in Japanese Patent Laid-Open No. 2009-153802 mentioned above, when the protrusion of the bulged portion is removed to form a thin portion, a trace of removal of the protrusion of the bulged portion remains in the crown portion. Hence, the boundary between the removed bulged portion and the unremoved portion surrounding it becomes conspicuous, and degrades the aesthetic appearance.

SUMMARY OF THE INVENTION

It is the first object of the present invention to make it possible to easily manufacture a golf club head having a metal plate portion with thin, thick, and medium thick portions at a low cost.

It is the second object of the present invention to provide a golf club head which has a metal plate portion with thin and thick portions, and exhibits a good aesthetic appearance.

In order to achieve the first object, according to the present invention, there is provided a hollow golf club head including a metal plate portion provided with a thin portion and a thick portion, wherein a medium thick portion having an intermediate thickness between a thickness of the thin portion and a thickness of the thick portion is formed at a boundary portion between the thin portion and the thick portion, and the thin portion and the medium thick portion are formed by the steps of pressing the metal plate portion to form a recess in one surface of the metal plate portion and a projection on the other surface thereof, performing chemical milling of the recess and a portion surrounding the recess, and removing the projection by grinding. A method of manufacturing the same is also provided.

In order to achieve the second object, according to the present invention, there is provided a hollow golf club head including a metal plate portion provided with a thin portion and a thick portion, wherein the thin portion is formed by the steps of forming a recess in a head inner surface of the metal plate portion and a projection on a head outer surface thereof, and removing the projection by grinding, and a low-reflection coating is applied onto the outer surface of the metal plate portion. A method of manufacturing the same is also provided.

Further features of the present invention will become apparent from the following description of exemplary embodiments with reference to the attached drawings.

DESCRIPTION OF THE EMBODIMENTS

<First Embodiment>

Figure 1:
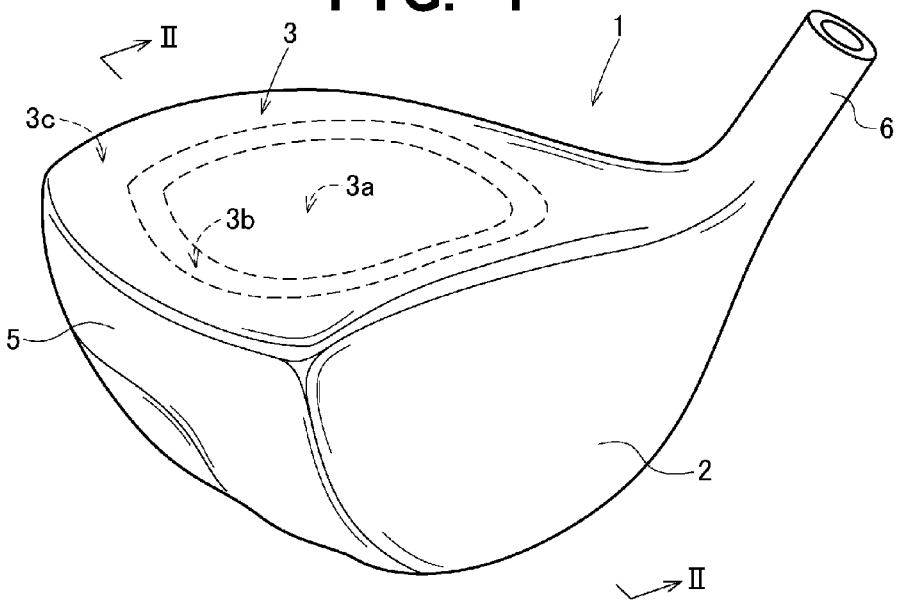
FIG. 1 is a perspective view of a golf club head according to an embodiment of the present invention.
Figure 2:
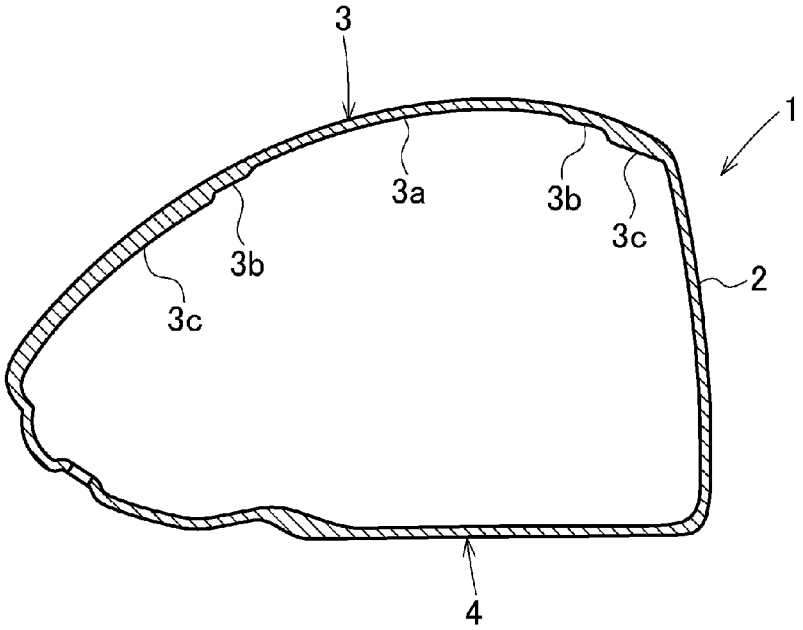
FIG. 2 is a sectional view taken along a line II-II in FIG. 1.

An embodiment will be described below with reference to FIGS. 1 and 2.

A golf club head 1 is a hollow driver head, and has a face portion 2, crown portion 3, sole portion 4, side portion 5, and hosel portion 6. The golf club head 1 is made of a titanium alloy.

The golf club head 1 is manufactured by, for example, forming a crown portion and the remaining portions (head body) as separate portions, and integrating these portions by welding such as laser welding or plasma welding. Note that the crown portion and face portion may be integrated with each other, and welded to the remaining portions to serve as the head body. The crown portion and face portion may be formed as separate portions, and welded to the remaining portions to serve as the head body.

The head body is a cast product, which can be easily manufactured even when a complex shape is formed. However, the head body may be a forged product.

The central portion of the crown portion 3 constitutes a thin portion 3*a*, its surrounding portion constitutes a medium thick portion 3*b*, and its surrounding portion constitutes a thick portion 3*c*. The area of the thin portion 3*a* is preferably 30% to 90%, and more particularly about 60% to 80% of that of the crown portion 3. The width of the medium thick portion 3*b* (the average width in the direction from the thin portion 3*a* to the thick portion 3*c*) is preferably 5 to 25 mm, and more particularly about 10 to 15 mm.

The thickness of the thick portion 3*c* is preferably 0.6 to 1.2 mm, and more particularly about 0.7 to 0.9 mm. The thickness of the thin portion 3*a* is preferably 30% to 70%, and more preferably about 40% to 60% of that of the thick portion 3*c*, and the thickness of the medium thick portion 3*b* is preferably 50% to 90% and more preferably about 60% to 80% of that of the thick portion 3*c*.

Figure 3A:
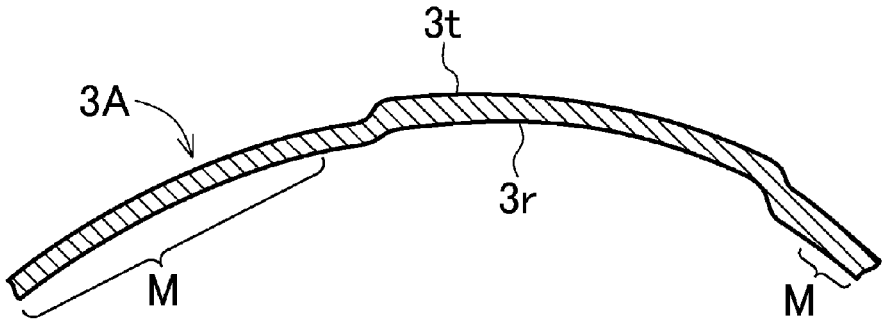
FIGS. 3A and 3B are sectional views showing a method of manufacturing a crown portion.
Figure 3B:
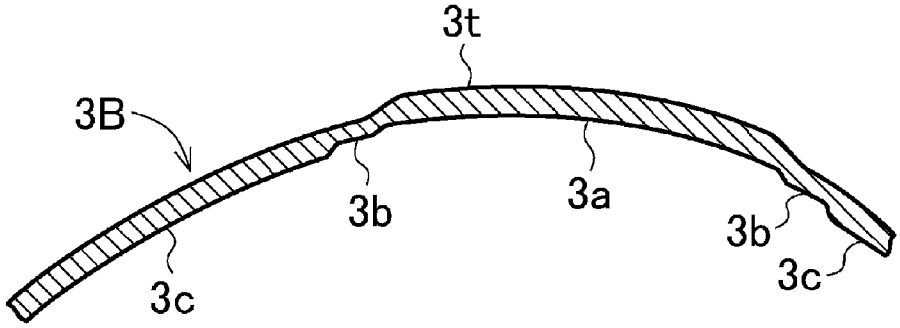

To manufacture the crown portion 3, a plate made of titanium or a titanium alloy is pressed to form a blank plate 3A, as shown in FIG. 3A. The blank plate 3A is curved in the shape of the crown portion 3, and is provided with a recess 3*r* and projection 3*t* on the inner and outer surface sides, respectively, of the golf club head 1. The entire blank plate 3A has a uniform thickness. Regions M other than the recess 3*r* and its surrounding portion on the inner surface side of the blank plate 3A are masked. As a masking material, a coating such as an acrylic resin coating is preferable. A chemical milling process is then performed on the inner surface side of the blank plate 3A using a titanium etching solution such as an acid mixture of hydrofluoric acid and nitric acid. Note that at this time, it is preferable to mask the entire outer surface of the blank plate 3A, and immerse the blank plate 3A in an etching solution to perform a chemical milling process of the recess 3*r* and its surrounding portion. With this operation, a blank plate 3B shown in FIG. 3B is obtained. The blank plate 3B has the thin portion 3*a*, medium thick portion 3*b*, and thick portion 3*c*. The projection 3*t* of the blank plate 3B is removed by grinding, and the masking material is removed to form a crown portion shape shown in FIGS. 1 and 2.

Since the golf club head 1 configured as mentioned above has a thin portion at the central portion of the crown portion 3, it easily flexes upon hitting a golf ball, increases the launch angle of the golf ball, and improves the repulsive force to increase the flight distance.

The golf club head 1 is provided with the medium thick portion 3*b* between the thin portion 3*a* and the thick portion 3*c*, so stress is dispersed upon hitting a golf ball. This makes it possible to improve the durability of the golf club head 1. It is also possible to improve an impact feel and an impact sound.

As shown in FIGS. 3A and 3B, the crown portion of the golf club head 1 is manufactured by pressing and chemical milling, so the depths of the thin portion 3*a* and medium thick portion 3*b*, and the width of the medium thick portion 3*b* can be changed to various values by changing the masking regions and chemical milling conditions. Hence, by changing these depths and width to various values, crown portions with various specifications can be manufactured at a low cost using a common press die.

As described above, a golf club head according to this embodiment has a metal plate portion with thick and thin portions, and a medium thick portion at their boundary. Hence, stress is dispersed upon hitting a golf ball more widely in this golf club head than in a golf club head having only thick and thin portions.

Because the medium thick portion is formed by chemical milling, the press die need not have a step portion for forming the medium thick portion. This makes it possible to form metal plate portions having medium thick portions with various shapes using one press die, and, in turn, to reduce the manufacturing cost of a golf club head.

<Second Embodiment>

A golf club head 1' according to another embodiment will be described with reference to FIGS. 4A and 4B.

In the golf club head 1', a plurality of thin portions 3*d* are formed in a crown portion 3' to extend in the front-to-back direction. The thin portions 3*d* are aligned in the toe-to-heel direction with gaps between them. Medium thick portions 3*e* are formed on the two sides (toe and heel sides) of each thin portion 3*d*. Other constituent components are the same as in the golf club head 1, and the same reference numerals denote the same parts.

The crown portion 3' of the golf club head 1' is also manufactured by pressing a titanium or titanium alloy plate to form a blank plate having a recess and projection, performing a chemical milling process on the blank plate, and removing the projection by grinding.

Figure 4A:
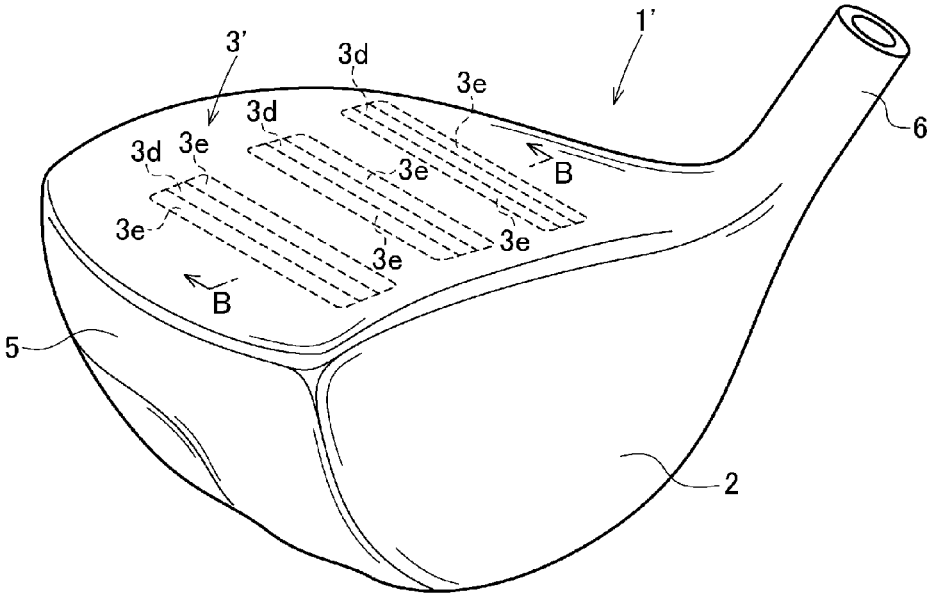
FIG. 4A is a perspective view of a golf club head according to another embodiment.
Figure 4B:
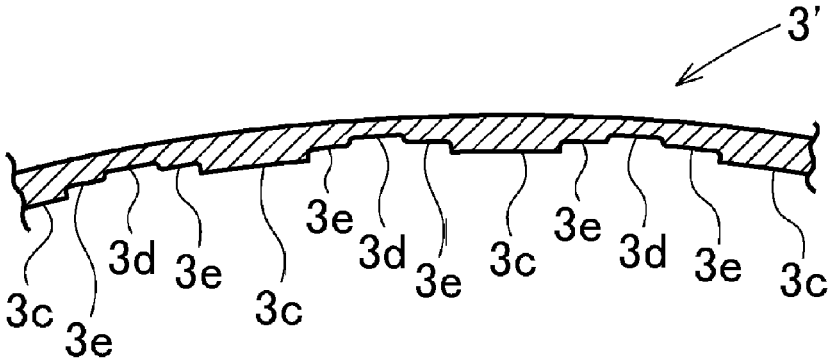
FIG. 4B is a sectional view taken along a line B-B in FIG. 4A.

Although the thin portions 3*d* and medium thick portions 3*e* extend in the front-to-back direction in the golf club head 1' shown in FIGS. 4A and 4B, they may extend in the toe-to-heel direction.

Although all of thin, medium thick, and thick portions are formed in the crown portion in the above-mentioned embodiment, they may be formed in the side, heel, face or sole portion using a similar method.

<Third Embodiment>

The crown portion 3 of the golf club head 1 according to the above-mentioned first embodiment, or the crown portion 3' of the golf club head 1' according to the above-mentioned second embodiment may be coated with a low-reflection coating. By applying a low-reflection coating to the crown portion 3 or 3', the boundary between a trace of grinding removal of the projection 3*t* and the unremoved region surrounding it becomes inconspicuous and excellent in aesthetic appearance. Note that a low-reflection coating may be applied to portions other than the crown portion. The low-reflection coating preferably has a gloss value of 40 to 70 and more preferably 40 to 60.

Although a medium thick portion is formed in the above-mentioned first and second embodiments, a low-reflection coating is also applicable to a golf club head provided with only thin and thick portions formed by pressing or grinding while omitting a medium thick portion.

A matte coating suitable as a low-reflection coating will be described next. As a base coating resin for a matte coating, various base coating resins for golf club heads, such as polyester resin, epoxy resin, acrylic resin, silicone resin, and fluorocarbon resin, can be used. A matte coating is prepared by blending a silica powder with the base resin. The average particle size of a silica powder is preferably about 0.1 to 20 μm. The gloss value of a coating is preferably 40 to 70 and more preferably about 40 to 60 in determining the amount of blending of a silica powder.

The coating may contain, for example, a pigment, curing catalyst, plasticizer, polymerization inhibitor, anti-settling agent, solvent, antifoaming agent, deposition aid, thickener, dispersant, germicide, and ultraviolet absorber.

To apply a coating, first, the head is undercoated. Examples of this undercoating process are priming and ion plating. As a coating method, various methods such as brush coating, spray coating, and electrostatic coating can be used. Note that the head may be coated twice or more, and a matte coating is applied to at least the top layer in this case. The coating thickness (the total thickness when two or more layers are applied) is preferably 10 to 80 μm and more preferably about 40 to 60 μm.

With this arrangement, the golf club head according to this embodiment has a metal plate portion with a thick portion, and a thin portion formed by grinding removal of a projection, and its outer surface is coated with a low-reflection coating, so the boundary between a trace of grinding removal of the projection 3*t* and the unremoved region surrounding it becomes inconspicuous and excellent in aesthetic appearance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-141166, filed Jun. 22, 2012, and No. 2012-141167, filed Jun. 22, 2012, which are hereby incorporated by reference herein in their entirety.

What is claimed is:

1. A hollow golf club head including a metal plate portion provided with a thin portion and a thick portion, wherein a medium thick portion having an intermediate thickness between a thickness of the thin portion and a thickness of the thick portion is formed at a boundary portion between the thin portion and the thick portion, the metal plate portion includes a crown portion, the medium thick portion is formed around the entire thin portion, the thin portion is formed at the central portion of the crown portion to occupy 30% to 90% of an area of the crown portion, and a width of the medium thick portion is 5 to 25 mm, the thickness of the thin portion is 30% to 70% of the thickness of the thick portion, and the thickness of the medium thick portion is 50% to 90% of the thickness of the thick portion.

2. The head according to claim 1, wherein the thin portion and the medium thick portion are formed by the steps of:

pressing the metal plate portion to form a recess in one surface of the metal plate portion and a projection on the other surface thereof;

performing chemical milling of the recess and a portion surrounding the recess; and removing the projection by grinding, and wherein the recess is formed on an inner surface side of the golf club head.

3. The head according to claim 1, wherein a low-reflection coating is applied onto the outer surface of the metal plate portion.

4. The head according to claim 3, wherein a gloss value of the low-reflection coating is 40 to 70.

* * * * *